US006470657B2

(12) United States Patent
Huson et al.

(10) Patent No.: US 6,470,657 B2
(45) Date of Patent: Oct. 29, 2002

(54) PORTABLE FILM WRAPPING SYSTEM

(75) Inventors: Gale W. Huson, Glenview, IL (US); Hugh J. Zentmyer, Green Oaks, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 5 days.

(21) Appl. No.: 09/814,861

(22) Filed: Mar. 23, 2001

(65) Prior Publication Data

US 2002/0134058 A1 Sep. 26, 2002

(51) Int. Cl.[7] ..... B65B 11/02
(52) U.S. Cl. ..... 53/588; 53/390; 53/556
(58) Field of Search ..... 53/588, 390, 587, 53/210, 556

(56) References Cited

U.S. PATENT DOCUMENTS

| | | | | | |
|---|---|---|---|---|---|
| 4,067,174 | A | * | 1/1978 | Goldstein | 53/210 |
| 4,095,395 | A | * | 6/1978 | Goldstein | 53/210 |
| 4,369,614 | A | * | 1/1983 | Tetzner | 242/557 |
| 4,409,776 | A | * | 10/1983 | Usui | 493/112 |
| D272,540 | S | | 2/1984 | Goldstein | |
| 4,745,726 | A | * | 5/1988 | Rosenthal et al. | 187/362 |
| 4,756,143 | A | * | 7/1988 | Lancaster | 53/556 |
| 4,938,008 | A | | 7/1990 | Salzsauler | |
| 5,296,079 | A | | 3/1994 | Romo | |
| 5,398,884 | A | | 3/1995 | Stanford | |
| 5,423,163 | A | | 6/1995 | Wendt | |
| 5,458,841 | A | | 10/1995 | Shirrell | |
| 5,561,971 | A | * | 10/1996 | Sampson | 53/390 |
| 5,673,542 | A | * | 10/1997 | Vartanian et al. | 53/390 |
| 5,779,179 | A | | 7/1998 | Zentmyer et al. | |
| 5,941,049 | A | * | 8/1999 | Lancaster et al. | 53/399 |

OTHER PUBLICATIONS

Operators Manual, Model G–200, Low Profile Stretchwrap Machine, Manual Spiral Wrapper, Gerrard & Company, Apr., 1998.

* cited by examiner

*Primary Examiner*—Rinaldi I. Rada
*Assistant Examiner*—Paul Durand
(74) *Attorney, Agent, or Firm*—Schwartz & Weinrieb

(57) ABSTRACT

A portable film wrapping system comprises a push-cart having a vertical mast member and a film roll carriage movably mounted upon the vertical mast member. A lift cable connects the film roll carriage to a lift cable drum which is rotatably connected to a lift sprocket through a clutch mechanism, wherein the lift sprocket is rotatably connected to a drive wheel engaged with a floor surface over which the portable system is movable. When the clutch mechanism operatively connects the lift cable drum to the lift sprocket, the lift cable drum is rotated so as to wind the lift cable thereon and thereby continuously elevate the film roll carriage whereby spiral wrapping is achieved. When the clutch mechanism disconnects the lift cable drum from the lift sprocket, the lift cable is no longer wound upon the lift cable drum whereby the film roll carriage is maintained at a particular elevation so as to achieve concentric reinforcing wrapping.

25 Claims, 4 Drawing Sheets

PORTABLE FILM WRAPPING SYSTEM

FIELD OF THE INVENTION

The present invention relates generally to film wrapping apparatus, and a method for performing the same with respect to palletized loads or products, and more particularly to a new and improved film wrapping apparatus or system which is truly portable and readily enables the manual wrapping of palletized loads or products with wrapping film.

BACKGROUND OF THE INVENTION

As has been noted within previously filed U.S. patent application Ser. No. 09/432,284, which was filed on Nov. 2, 1999 and in the name of Hugh J. Zentmyer et al. for an APPARATUS AND METHOD FOR MANUALLY APPLYING STRETCH FILM TO PALLETIZED PRODUCTS, it is a known fact that approximately fifty per-cent (50%) of all stretch film that is manufactured is applied to, for example, palletized loads or products by manual means. It is also known that when applying such stretch film to, for example, palletized loads or products, the manner in which such stretch film is manually applied to such loads or products usually comprises either one of two methods. In accordance with a first one of such manual methods, as illustrated, for example, within U.S. Pat. No. 5,398,884 which issued to Stanford on Mar. 21, 1995, the operator respectively inserts four fingers of each hand into each one of two oppositely disposed recessed portions defined within the film core end caps so as to effectively hold or grasp the film roll, and while placing his thumbs upon outside surface portions of the film roll, so as to effectively cause a predetermined amount of back tension to be applied to the film whereby the film is effectively stretched as the film is being unrolled or dispensed from the film roll, the operator walks around the palletized load or product. In accordance with a second one of such manual methods of applying a stretch film to such palletized loads or products, as illustrated, for example, within U.S. Pat. No. 5,458,841 which issued to Shirrell on Oct. 17, 1995, and in lieu of directly holding or grasping the film roll, the operator holds or grasps a film roll dispensing or holding device which has a built-in tensioning mechanism.

In accordance with either one of the aforenoted modes, methods, or manners in which stretch film is applied manually to the palletized products or loads, several operational disadvantages or drawbacks common to both methods or modes were apparent. Firstly, for example, the film roll, or the film roll and film roll dispensing or holding device, must be supported by the operator personnel, and yet the film roll and the film roll dispensing or holding device are quite heavy and cumbersome. In addition, in order to fully wrap a palletized load, the operator must bend down while holding the film roll, or the film roll and film roll dispensing or holding device, in order to wrap the film around the lower extremity portions of the palletized loads or products. Such requirements upon the operator personnel have been noted to cause acute discomfort, fatigue, and stress-related injuries. In addition, the operators experience fatigue and discomfort even when the operators are wrapping the upper regions of the palletized loads or products due to the continuous need for supporting the entire weight of the film roll, or the film roll and film roll dispensing or holding device.

A need therefore existed in the art for an apparatus, and for a method of operating the same, for overcoming the various operational disadvantages or drawbacks characteristic of the known PRIOR ART systems as briefly discussed hereinbefore and as disclosed within the aforenoted patents, and this need was substantially met by means of the apparatus or system, and the method of operating the same, which has been disclosed within the aforenoted U.S. patent application Ser. No. 09/432,284 and which has been quite commercially successful. However, while it has been noted in such aforenoted patent application that the apparatus or system disclosed within the aforenoted U.S. patent application Ser. No. 09/432,284 is portable in that the same is mounted upon a platform which has wheels, rollers, or the like so as to render the same movable or mobile, the apparatus is nevertheless relatively large and not readily transportable so as to, in turn, not be readily or easily movable within a particular wrapping plant or facility, or even yet further, readily or easily transportable between different wrapping plants or facilities located at different production sites.

A need therefore exists in the art for a new and improved film wrapping apparatus wherein the film wrapping apparatus is truly portable and transportable so as to readily enable the manual wrapping of palletized loads or products with wrapping film at a particular location within a production facility, at different locations within a particular production facility, or at different production facilities.

OBJECTS OF THE INVENTION

Accordingly, it is an object of the present invention to provide a new and improved apparatus or system for applying wrapping film to palletized loads or products.

Another object of the present invention is to provide a new and improved apparatus or system for applying wrapping film to palletized loads or products wherein the various operational drawbacks and disadvantages, characteristic of PRIOR ART apparatus, systems, or methods of operating the same, are overcome.

An additional object of the present invention is to provide a new and improved apparatus or system for applying wrapping film to palletized loads or products wherein the wrapping film can be applied to or wrapped around the palletized loads or products by means of operator personnel who can simply walk around the pallet upon which the loads or products are disposed and simultaneously push or guide the roll of wrapping film around the palletized loads or products whereby the palletized loads or products are accordingly packaged with such wrapping film.

A further object of the present invention is to provide a new and improved apparatus or system for applying packaging film to palletized loads or products wherein the packaging film can be applied to or wrapped around the entire vertical extent of the palletized loads or products by means of operator personnel who need not support the weight of the film roll, or the film roll and the film roll dispensing mechanism, and in addition need not bend down in order to wrap or apply the stretch film upon or to the lower extremity portions of the palletized loads or products.

A still yet further object of the present invention is to provide a new and improved apparatus or system for applying packaging film to palletized loads or products wherein the film wrapping apparatus or system is truly portable and transportable so as to readily enable the manual wrapping of palletized loads or products with wrapping film at a particular location within a production facility, at different locations within a particular production facility, or at different production facilities.

SUMMARY OF THE INVENTION

The foregoing and other objectives are achieved in accordance with the teachings and principles of the present invention through the provision of a new and improved portable film wrapping apparatus or system which comprises, in effect, a manually movable cart which is formed by means of a chassis wherein a pair of relatively large non-pivotal or non-caster type wheels are mounted upon a rear end portion of the chassis while a pair of relatively small pivotal or caster-type wheels are mounted upon a front end portion of the chassis. The pair of relatively large rear wheels are mounted upon an axle in such a manner that one of the relatively large rear wheels is fixed upon the axle, while the other one of the relatively large rear wheels is freely rotatable upon the axle, and in this manner, the first relatively large rear wheel serves as a drive wheel to drive the axle. A drive sprocket is also mounted, through means of a one-way clutch mechanism, upon the axle on which the large drive wheel is mounted such that when the drive wheel is rotated in a forward direction, rotational drive is transmitted to the drive sprocket, whereas conversely, when the drive wheel is rotated in the backward or reverse direction, rotational drive is not transmitted to the drive sprocket. A lift drum bridge is mounted upon a relatively central portion of the chassis, and a clutch shaft is fixedly mounted upon the lift drum bridge. A lift sprocket is rotatably mounted upon the clutch shaft and is operatively connected to the drive sprocket by means of a drive chain. A lift drum is also mounted upon the clutch shaft and is spring-biased into contact with the lift sprocket by means of a pin-and-hole clutch mechanism defined between the lift drum and the lift sprocket such that when the clutch mechanism is engaged, the lift drum is rotated by means of the lift sprocket. A lift cable is connected at one end thereof to the lift drum so as to be wrapped around the lift drum as the system cart is manually maneuvered, along a circular locus around a load to be packaged in wrapping film, by means of an operator, and the other end of the lift cable is attached to a film roll carriage which is vertically movable along a track defined upon an upstanding mast and upon which a roll of wrapping film is mounted.

Accordingly, as the operator continuously maneuvers the system cart around the load to be packaged in wrapping film, rotation of the large drive wheel causes rotation of the drive sprocket which in turn causes rotation of the lift sprocket and the lift drum. Consequently, the lift cable is wrapped around the lift drum and the film roll carriage is elevated so as to continuously enable dispensing of the packaging film and wrapping of the same around the entire vertical extent of the load being wrapped in a spiral wrap mode. If continuous or concentric wrapping of the load with the packaging film at a particular elevational level is desired, which is known as reinforcing wrapping, the lift drum is operatively disengaged from the lift sprocket such that the lift drum is no longer rotated and the lift cable is not wound any further upon the lift drum. The system further comprises a spring-biased, one-way pawl mechanism which is pivotally movable with respect to the lift cable so as to permit the lift cable to be wound upon the lift drum during elevation of the film roll carriage attendant a film wrapping operation. However, conversely, the one-way pawl mechanism is biased into engagement with the lift cable in order to prevent the cable from unwinding with respect to the lift drum so as to in turn prevent the film roll carriage from descending when such descent is not desired, such as, for example, when the cart is not being moved, when the cart is being moved in a reverse direction, when the cart is being moved during the performance of a reinforcing wrap operation, or when the cart is being moved along the ground or floor of a facility so as to be transported between different packaging or wrapping locations.

In order to in fact permit the film roll carriage to descend, such as, for example, upon the completion of a particular load wrapping operation and in order to prepare for the initiation of a new wrapping operation with respect to a new load to be wrapped, the one-way pawl is adapted to be disengaged from the lift cable such that the cable is in fact free to unwind from, or with respect to, the lift drum. In conjunction with the disengagement of the one-way pawl mechanism, a jack lever is also operated so as to elevate the large drive wheel with respect to the ground or floor and thereby disengage the same from its contact with the ground or floor of the wrapping facility or plant. In this manner, reverse rotation of the lift drum, through means of the rotation of the lift sprocket, the drive sprocket, and the large drive wheel, is permitted or facilitated such that descent of the film roll carriage is then permitted in a predeterminedly controlled manner as defined or determined by means of the tooth ratio defined between the teeth of the drive sprocket and the teeth of the lift sprocket.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
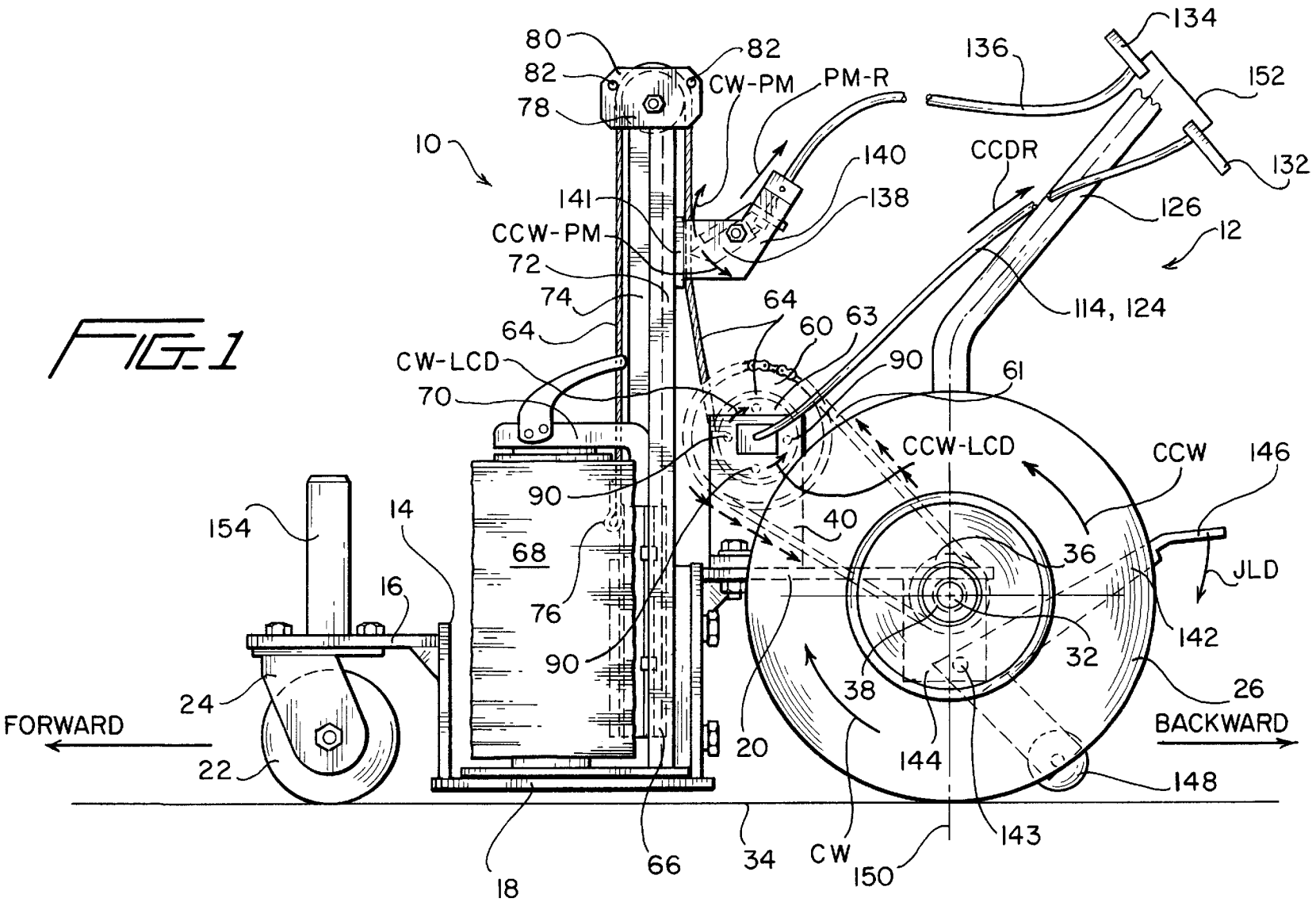
FIG. 1 is a side elevational view of a first embodiment of a new and improved portable film wrapping apparatus or system which has been constructed in accordance with the principles and teachings of the present invention and which discloses the cooperative parts thereof.

Referring now to the drawings, and more particularly to FIG. 1 thereof, there is disclosed a first embodiment of a new and improved portable film wrapping apparatus or system which has been constructed in accordance with the principles and teachings of the present invention and which has been designated by the reference character 10. As can be readily seen and appreciated from FIG. 1, especially when considered in conjunction with FIG. 7 which comprises an overall perspective view of an essentially identical, but slightly modified, second embodiment 210 of a new and improved portable film wrapping apparatus or system which has likewise been constructed in accordance with the principles and teachings of the present invention and which will be discussed further hereinafter, the portable film wrapping apparatus or system 10 comprises a manually movable and steerable cart 12 upon which the various components of the apparatus or system 10 are mounted.

More particularly, it is noted that the manually movable and steerable cart 12 comprises a chassis 14 which, in turn, is seen to comprise a front or forward horizontal deck portion 16, a substantially centralized horizontal deck portion 18, and a back or rearward horizontal deck portion 20. A pair of laterally spaced, pivotal or steerable caster wheels 22, having a relatively small diametrical extent, are adapted to be mounted upon underside portions of the forward horizontal deck portion 16 of the chassis 14 through means of suitably conventional mounting bracket and bearing assemblies 24, it being noted that only one of such wheels 22 is actually shown in FIG. 1, and in a similar manner, a pair of laterally spaced, non-pivotal or non-steerable wheels 26, having a relatively large diametrical extent, are adapted to be mounted upon the rearward horizontal deck portion 20 of the chassis 14. As can be better appreciated as a result of additional reference being made to FIG. 6, undersurface portions of the rearward horizontal deck portion 20 of the chassis 14 are provided with a pair of laterally spaced, dependent mounting brackets 28 having through-bores 30 defined therein for accommodating a wheel axle 32 upon opposite ends of which the relatively large wheels 26 are adapted to be mounted.

In particular, the relatively large wheel 26, which is disposed upon the left side of the cart 12 and which is visible in FIG. 1, is adapted to be fixed upon the axle 32 such that when such left side wheel 26 is rotated as a result of the cart 12 being moved along a facility or packaging plant floor 34, the axle 32 will in effect be driven by means of such left side wheel 26 so as to likewise be rotated in the same angular direction. Conversely, the relatively large wheel 26, which is disposed upon the right side of the cart 12 and which is not visible in FIG. 1, is mounted upon the axle 32 in a free-wheeling manner whereby such right side wheel 26 is simply rotated as the cart 12 is moved along the facility or plant floor 34 and does not serve to drive the axle 32. In this manner, the movement of the cart 12 along a circular locus, as determined by means of an operator attendant a load wrapping or packaging operation being performed in connection with the wrapping or packaging of a palletized load disposed at a wrapping station, is facilitated without requiring, for example, the incorporation upon the vehicle cart 12 of a differential mechanism as is present upon the rear axle of an automobile.

With reference continuing to be made to FIG. 1, in addition to the relatively large wheels 26 being mounted upon the axle 32, there is also mounted thereon a relatively small diameter drive sprocket 36 which has operatively associated therewith a one-way roller clutch 38. Accordingly, when the left side drive wheel 26 is rotated in the counter-clockwise direction, as shown by the arrow CCW in FIG. 1, as a result of the forward movement of the cart 12 along the floor 34 in the leftward direction, as shown by the arrow FORWARD in FIG. 1, as guided by means of the wrapping or packaging operator, axle 32 will likewise be rotated in the counterclockwise direction whereby, in turn, drive sprocket 36, through means of its one-way roller clutch 38, will also be rotated in the counterclockwise direction. Conversely, if the cart 12 is moved along the floor 34 in the rightward direction, as shown by the arrow BACKWARD in FIG. 1, as when, for example, the operator personnel should, for any one of various reasons, move the cart 12 in a backward or reverse direction, drive wheel 26 and axle 32 will be rotated in the clockwise direction, as shown by the arrow CW in FIG. 1, however, such rotational or angular movement of the drive wheel 26 will not be transmitted to the drive sprocket 36 because the one-way roller clutch 38 will in effect permit slippage to occur between the axle 32 and the drive sprocket 36. The reason for the provision of this interrelated structure within the drive wheel subsystem will be discussed further hereinafter.

Figures 3, 4, 5, 6:
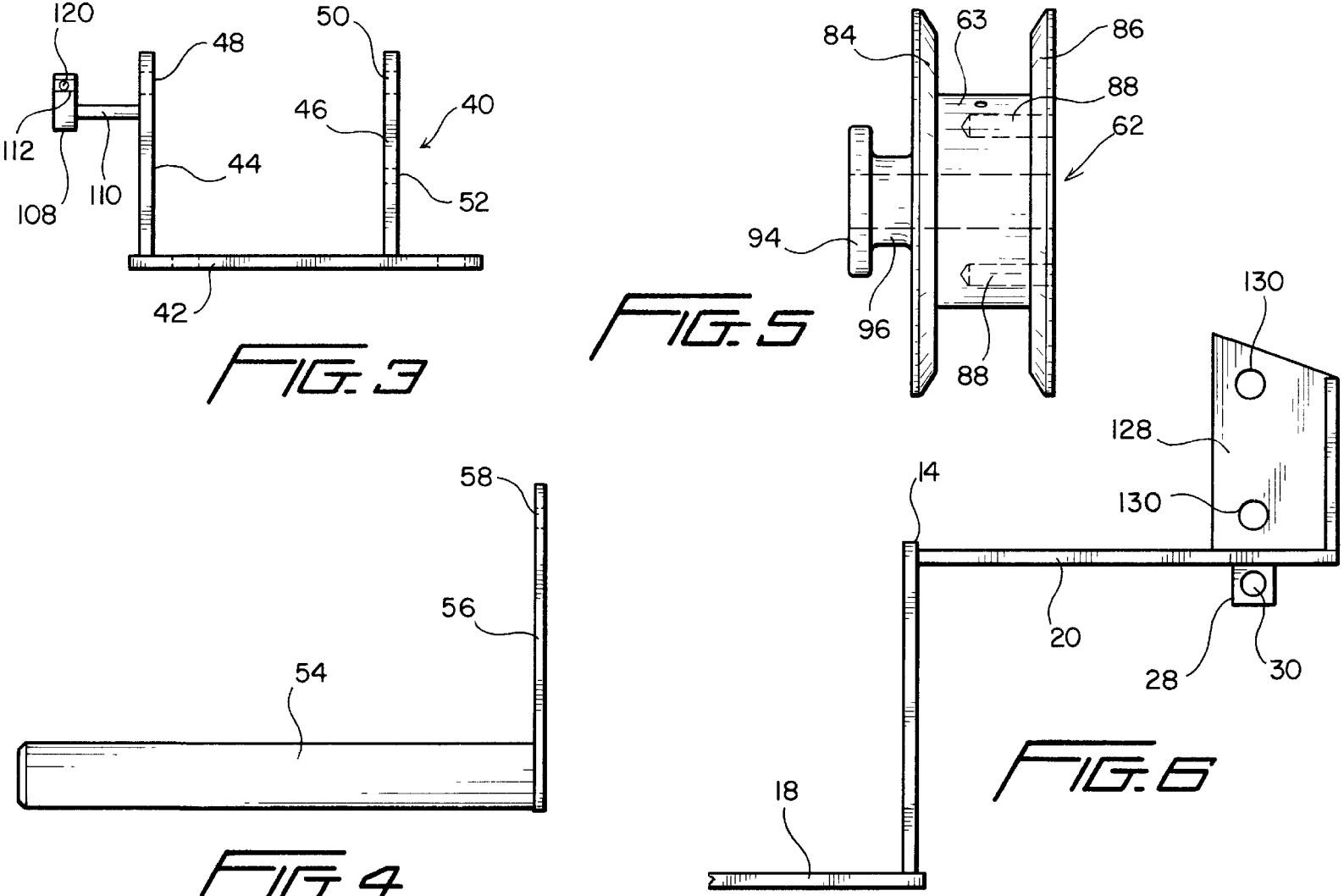
FIG. 3 is side elevational view of the lift drum bridge component of the portable film wrapping apparatus or system of the present invention.
FIG. 4 is a side elevational view of the clutch shaft component of the portable film wrapping apparatus or system of the present invention wherein the clutch shaft component is to be mounted upon the lift drum bridge component shown in FIG. 3.
FIG. 5 is a side elevational view of the lift drum component of the portable film wrapping apparatus or system of the present invention wherein the lift drum is adapted to be mounted upon the clutch shaft component of the apparatus or system of the present invention as shown in FIG. 4.
FIG. 6 is a partial side elevational view of the cart chassis component of the portable film wrapping apparatus or system of the present invention showing additional details thereof for mounting thereon the large wheel axle and push bar components of the portable film wrapping apparatus or system of the present invention.

Continuing further, and with additional reference being made to FIGS. 2–5, it is seen that the back or rearward horizontal deck portion 20 of the chassis 14 has a lift drum bridge 40 fixedly mounted thereon. As best seen from FIG. 3, the lift drum bridge 40 is seen to comprise a base member 42 and a pair of laterally spaced upstanding support walls 44, 46. The upper end portion of each upstanding support wall 44, 46 is respectively provided with a through-bore 48, 50 which are axially aligned with respect to each other, and a substantially vertically central portion of the upstanding support wall 46 is also provided with an aperture 52. This structure permits the mounting of a clutch shaft 54, which is shown in detail in FIG. 4, to be mounted upon the lift drum bridge 40 in an assembled manner as can best be seen in FIG. 2. More particularly, as seen in FIG. 4, the clutch shaft 54 has a mounting bracket 56 integrally secured to one end thereof so as to extend within a plane perpendicular to the axial extent of the clutch shaft 54, and the mounting bracket 56 is provided with an aperture 58 which is adapted to be axially aligned with the aperture 52 defined within the upstanding support wall 46 of the lift drum bridge 40 when the clutch shaft 54 is axially mounted within the apertures 48,50 of the upstanding support walls 44,46 of the lift drum bridge 40. Consequently, when a suitable fastener, not shown, is respectively secured within the apertures 58 and 52 of the clutch shaft mounting bracket 56 and the upstanding support wall 46 of the lift drum bridge 40, the clutch shaft 54 is fixedly mounted upon the lift drum bridge 40.

Figure 2:
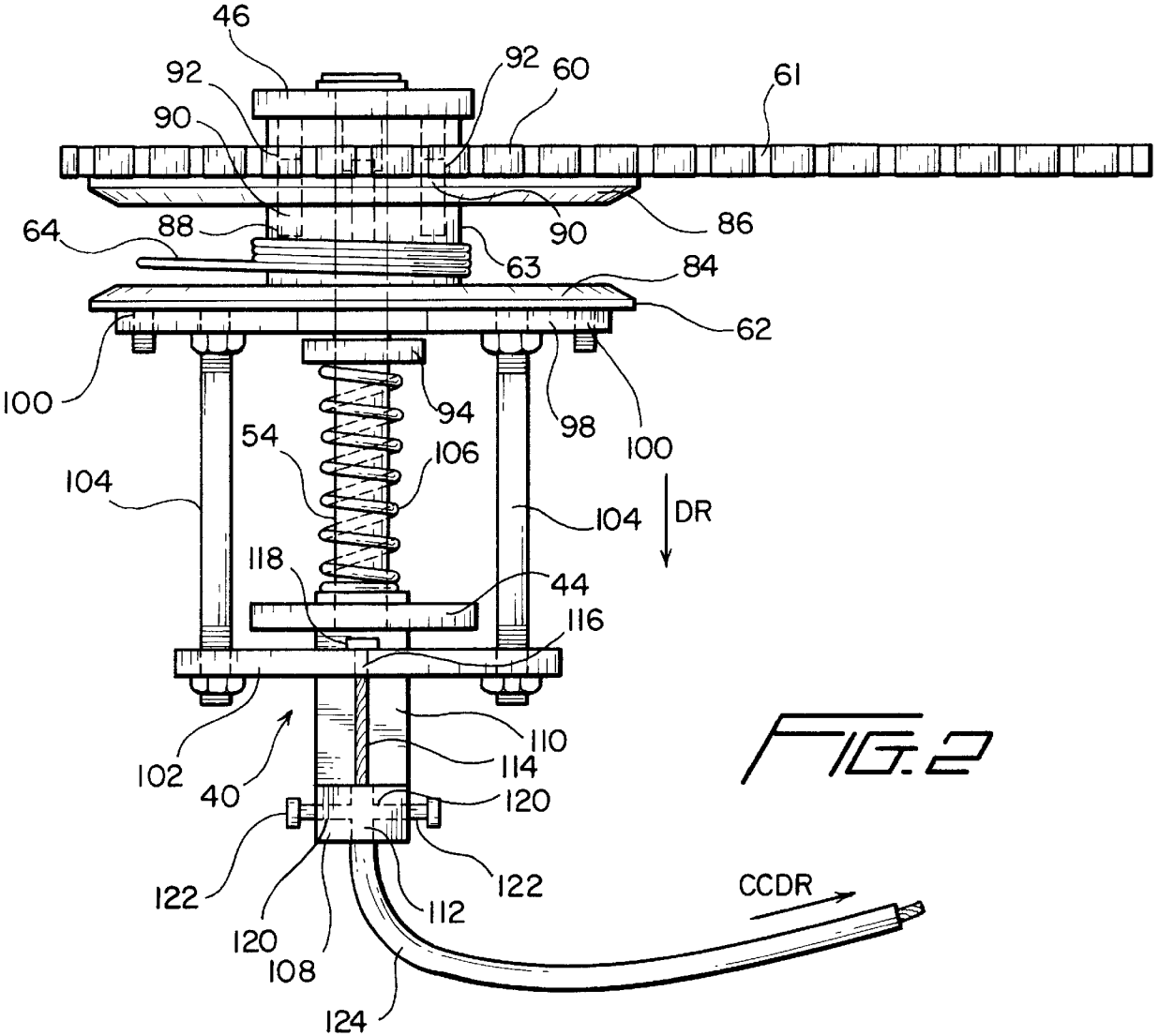
FIG. 2 is a top plan enlarged detailed view showing the clutch mechanism defined between the lift drum and the lift sprocket, and the actuation system operatively associated with the clutch mechanism so as to actuate the clutch mechanism in order to move the lift drum between its engaged driven position and its disengaged non-driven position.

As best seen from FIGS. 1 and 2, the clutch shaft 54 is adapted to have a relatively large-diameter lift sprocket 60 rotatably mounted thereon, and the lift sprocket 60 is operatively connected to the relatively small-diameter drive sprocket 36 through means of a drive chain 61. Accordingly, when the cart 12 is moved in the forward direction, rotational drive is transmitted from the left side drive wheel 26 to the lift sprocket 60 through means of the large wheel axle 32, one-way roller clutch 38 and small diameter drive sprocket 36, and drive chain 61. In addition to the mounting of the lift sprocket 60 upon the clutch shaft 54, a film roll carriage lift cable drum 62 is likewise mounted upon the clutch shaft 54 such that when the lift cable drum 62 is operatively connected to the lift sprocket 60 so as to be rotated in the counterclockwise direction, as indicated by the arrow CCW-LCD as seen in FIG. 1, a film roll carriage lift cable 64 is wound upon a hub portion 63 of the lift cable drum 62 whereby a film roll carriage 66 is raised or elevated in order to achieve a spiral wrap portion of a film wrapping operation cycle as will be more fully discussed hereinafter.

Conversely, when the lift cable drum 62 is operatively connected to the lift sprocket 60 and is rotated in the clockwise direction, as indicated by the arrow CW-LCD as seen in FIG. 1, the film roll carriage lift cable 64 is unwound from the hub portion 63 of the lift cable drum 62 whereby the film roll carriage 66 is permitted to descend, such as, for example, upon the completion of a particular film wrapping operation or cycle performed upon or in connection with a particular palletized load and in preparation for a new subsequent film wrapping cycle or operation to be performed by the film wrapping apparatus or system 10. It is of course appreciated that a wrapping film roll 68 is suitably mounted upon a substantially C-shaped framework 70 which is, in turn, mounted upon the film roll carriage 66, and that, still further, the film roll carriage 66 is adapted to be vertically movable, upwardly and downwardly, within a carriage track 72 which is defined upon a vertically upstanding mast member 74 which is fixedly secured at the lower end portion thereof to the substantially centralized horizontal deck portion 18 of the chassis 14. One end of the film roll carriage lift cable 64 is of course secured to the hub portion 63 of the lift cable drum 62, while the other opposite end of the film roll carriage lift cable 64 is secured to an upper end portion of the film roll carriage 66 by means of a suitable hook fastener 76. The film roll carriage lift cable 64 is adapted to be routed or trained over a cable pulley 78 which is rotatably mounted upon an upper end portion of the upstanding mast member 74 through means of a pair of cable pulley mounting brackets 80, only one of which is shown in FIG. 1. The pair of mounting brackets 80 is provided with a pair of tubular spacers 82, and it is seen that the lift cable 64 is interposed between the outer periphery of the cable pulley 78 and the spacers 82 such that the lift cable 64 is effectively prevented from becoming disengaged from its cable pulley 78.

During a film wrapping cycle or operation, wrapping film is desired to be applied to or wrapped around a load in accordance with two primary modes or techniques. More particularly, a first one of the desired wrapping modes or techniques comprises the continuous wrapping of the film around the load at a predetermined or fixed elevational position so as to achieve concentric or reinforcing wrapping, and the second one of the desired wrapping modes or techniques comprises the continuous wrapping of the film around the load at constantly changing elevational positions so as to achieve spiral wrapping of the palletized load. Wrapping of the film around the palletized load is of course continuously achieved as a result of forward movement of the cart 12 in accordance with the FORWARD arrow as noted in FIG. 1, and therefore in order to achieve the two aforenoted wrapping modes or techniques, means must be provided for alternatively achieving a non-winding mode of the film roll carriage lift cable 64 upon the hub 63 of the lift cable drum 62 in order to achieve the first concentric or reinforcing wrapping mode or technique, and similarly, for achieving a winding mode of the film roll carriage lift cable 64 onto the hub 63 of the lift cable drum 62 in order to achieve the second spiral wrapping mode or technique.

Accordingly, it is to be appreciated from FIGS. 1–3 and 5, that the lift cable drum 62 is adapted to be mounted upon the clutch shaft 54 in a clutch-type mode with respect to the lift sprocket 60 whereby the lift cable drum 62 can be alternatively rotationally engaged with the lift sprocket 60 whereby the film roll carriage lift cable 64 will be wound upon the hub portion 63 of the lift cable drum 62, or rotationally disengaged from the lift sprocket 60 whereby no further winding of the film roll carriage lift cable 64 onto the hub portion 63 of the lift cable drum 62 occurs. More particularly, as best seen from FIGS. 2 and 5, in addition to the hub portion 63, the lift cable drum 62 further comprises a pair of large diameter disk members 84, 86 which are integrally attached to opposite sides of the hub portion 63, and the disk members 84,86 of course serve to confine or retain the wound portion of the lift cable 64 upon the hub portion 63 of the lift cable drum 62. In addition, a plurality of bores, such as, for example, four bores 88, equiangularly spaced 90° apart, are provided within the hub portion 63 of the drum 62 and extend through the disk member 86, and the bores 88 are adapted to house a plurality of clutch pins 90 which are schematically illustrated in FIGS. 1 and 2.

In a similar manner, the lift sprocket 60 is provided with a plurality of clutch holes, such as, for example, eight holes 92, equiangularly spaced 45° apart, which are adapted to receive the four clutch pins 90. The lift sprocket 60 is intentionally provided with twice the number of clutch holes 92 as there are clutch pins 90 upon the lift cable drum 62 such that the clutch pins 90 can be engaged within the clutch holes 92 as a result of a maximum relative rotation of approximately 45° instead of 90° which would be required if only four clutch holes, similar to holes 92, were provided within the lift sprocket 60. Consequently, it can be readily appreciated that when the clutch pins 90 are disposed within the clutch holes 92 of the lift sprocket 60 such that the lift cable drum 62 is now rotationally engaged with the lift sprocket 60, rotational drive from the lift sprocket 60 can be transmitted to the lift cable drum 62, whereas, conversely, when the clutch pins 90 are removed from the clutch holes 92 of the lift sprocket 60 such that the lift cable drum 62 is now effectively rotationally disengaged from the lift sprocket 60, rotational drive from the lift sprocket 60 is no longer able to be transmitted to the lift cable drum 62.

In order to achieve the aforenoted clutch engaged and clutch disengaged states of the lift cable drum 62 with respect to the lift sprocket 60, the lift cable drum 62 is further provided with a flanged portion 94 which is integrally connected to the disk member 84 by means of a reduced diameter neck portion 96 as best seen in FIG. 5. A drum control ring 98, as seen in FIG. 2, comprises a two-piece member or fixture wherein the two pieces are able to be fixedly secured together by means of suitable fasteners, not shown. In this manner, the drum control ring 98 is able to be mounted and fixed upon the lift cable drum 62 so as encircle the reduced diameter neck portion 96 of the lift cable drum 62, and once so mounted, the drum control ring 98 is in effect axially trapped, as considered in the axial direction as taken along the clutch shaft 54, between the flanged portion 94 and the disk member 84 as best appreciated from FIG. 2. Radially outward regions of the drum control ring 98 are also provided with at least a pair of spring-biased ball detents 100 which are adapted to engage lift cable drum disk member 84 and thereby impart to, or impress upon, the lift cable drum disk member 84 a predetermined amount of relatively low-level drag or friction which will serve to initially prevent angular rotation of the lift cable drum 62 with respect to the lift sprocket 60 so as to facilitate the angular alignment of the lift sprocket clutch holes 92 with the lift cable drum clutch pins 90 as the lift sprocket 60 rotates relative to the lift cable drum 62 in order to establish the desired clutched engagement between the lift cable drum 62 and the lift sprocket 60.

Continuing further, a drum puller bar 102 is axially spaced from the drum control ring 98, as considered along the axial direction as defined by means of the clutch shaft 54, and the drum puller bar 102 is fixedly connected to the drum control ring 98 by means of a pair of axially extending threaded bolt assemblies 104,104. As best seen from FIG. 2, a coil spring 106 is coaxially disposed around the clutch shaft 54 such that opposite ends of the coil spring 106 respectively engage the upstanding support wall 44 of the lift drum bridge 40 and the flanged portion 94 of the lift cable drum 62. In this manner, the entire clutch subassembly, comprising the flanged portion 94 of the lift cable drum 62, as well as, of course, the lift cable drum 62 itself, the drum control ring 98, the bolt assemblies 104,104, and the drum puller bar 102, is biased toward the lift sprocket 60 so as to permit the lift cable drum 62 to be disposed at its clutch-engaged position with respect to the lift sprocket 60.

As best appreciated from FIGS. 2 and 3, the lift drum bridge 40 further comprises a control cable mounting block 108 which is integrally connected to the upstanding support wall 44 of the lift drum bridge 40 by means of a horizontally disposed support shelf 110 upon which the drum puller bar 102 is adapted to be supported. The control cable mounting block 108 is provided with an axially extending through-bore 112 through which a first control cable 114 is adapted to pass, and the free end of the first control cable 114 is also passed through another through-bore 116 which is defined within a central region of the drum puller bar 102. The free end portion of the first control cable 114 is provided with a crimped connection 118 whereby the first control cable 114 cannot be withdrawn from or retracted back out of its fixed position upon the drum puller bar 102. The control cable mounting block 108 is further provided with a pair of transversely oriented bores 120,120 within which a pair of sets screws 122,122 are provided for engaging the outer sheath portion 124 of the first control cable 114 which is axially disposed within the through-bore 112. In this manner, the cable sheath portion 124 of the first control cable 114 is relatively fixed within the control cable mounting block 108 while nevertheless permitting relative axial movement of the first control cable 114 with respect to its outer sheath portion 124. It can thus be appreciated that when first control cable 114 is pulled, in effect, in its axial direction as indicated by the arrow CCDR shown in FIG. 2, first control cable 114 will cause the aforenoted clutch subassembly, comprising the drum puller bar 102, the bolt assemblies 104,104, the drum control ring 98, the flanged portion 94 of the lift cable drum 62, and of course, the lift cable drum 62 itself, to be moved away from the lift sprocket 60 in the direction of arrow DR so as to remove the lift cable drum 62 from its clutch-engaged position with respect to the lift sprocket 60 and thereby drivingly disengage the lift cable drum 62 from the lift sprocket 60.

In order to provide for the manual pushing, steering, and manipulation of the film wrapping apparatus cart 12 by means of operator personnel, the cart 12 is further provided with a push bar structure which actually comprises a pair of laterally spaced vertically inclined push bar leg members 126 as seen in FIG. 1, although only one of the push bar leg members 126 is actually shown. As further seen in FIG. 6, the rearward horizontal deck portion 20 of the chassis 14 has a pair of laterally spaced upstanding mounting brackets 128 fixedly mounted thereon, only one of which is actually shown in FIG. 6, and each mounting bracket 128 is provided with a pair of apertures 130 by means of which suitable fasteners, not shown, can fixedly mount the lower end portion of each push bar leg member 126 to a respective one of the mounting brackets 128. The upper end portions of the push bar leg members 126 are integrally connected together by means of a push bar handle structure, not shown, and a first control lever 132 is adapted to be mounted upon such push bar handle structure, not shown. The first control lever 132 is operatively connected to the first control cable 114, in a manner similar to a conventional bicycle hand-lever brake actuation system, so as to control the clutched engagement and disengagement disposition of the lift cable drum 62 with respect to the lift sprocket 60 when so desired as will be discussed more fully hereinafter.

In a similar manner, as best seen in FIG. 1, a second control lever 134 is also adapted to be mounted upon the aforenoted push bar handle structure, not shown, and is operatively connected to a second control cable 136 which is used to control the disposition of a lift cable pawl mechanism 138. The lift cable pawl mechanism 138 is pivotally mounted upon and between a pair of laterally spaced mounting brackets 140, only one of which is shown in FIG. 1, wherein the mounting brackets 140 are fixedly mounted upon the upstanding film carriage mast member 74. In addition, the lift cable pawl mechanism 138 is normally spring-biased in the clockwise direction, as shown by the arrow CW-PM, into engagement with the lift cable 64 so as to normally compress or trap the same between the pawl mechanism 138 and a support surface 141 formed upon the mounting bracket assembly and thereby prevent movement of the lift cable 64 in the unwind direction with respect to, or from, the lift cable drum 62. However, when the film roll carriage 66 and the wrapping film roll 68 mounted thereon are desired to be lowered, as will be more fully discussed hereinafter, the lift cable pawl mechanism 138 may be pivotally actuated in the counterclockwise direction as noted by the arrow CCW-PM, through means of the second control lever 134 and the second control cable 136 operating in the direction of arrow PM-R, to its released or disengaged position with respect to the lift cable 64 so as to permit the lift cable 64 to undergo a retrograde or unwinding movement from or with respect to the lift cable drum 62 whereby the film roll carriage 66 and the wrapping film roll 68 are permitted to descend.

Having now described essentially all of the structural components of the new and improved portable film wrapping apparatus or system 10 as developed in accordance with the principles and teachings of the present invention, the operation of the new and improved portable film wrapping apparatus or system 10 will now be described. When a film wrapping operation or cycle is to be initiated, the apparatus or system 10 has its operative components disposed essentially in their states as disclosed within FIG. 1. More particularly, the film roll carriage 66, with, for example, a new or fresh roll of wrapping film 68 disposed thereon, is disposed at its lowermost position as illustrated in FIG. 1 and the operator begins the film wrapping operation by pushing the cart 12 around the palletized load wrapping station at which the particular palletized load, to be wrapped, is located. Normally, as soon as the operator begins to push or move the cart 12 in the forward direction as noted by the arrow FORWARD in FIG. 1, rotation of the drive wheel 26 will cause rotation of the axle 32, the drive sprocket 36 through means of its operatively associated one-way roller clutch 38, the drive chain 61, the lift sprocket 60, and the lift cable drum 62. Accordingly, the lift cable 64 will be wound upon the lift cable drum hub 63 and the film roll carriage 66, along with the wrapping film roll 68, will begin to rise or ascend.

However, when commencing a film wrapping operation upon a new palletized load to be wrapped, it is often desired that several layers of the wrapping film be initially applied to the lowermost region of the palletized load so as to constitute concentric or reinforcing wrapping, and therefore, it is initially desired to in effect disengage the lift cable drum 62 from its driven connection to the lift sprocket 60 so that the film roll carriage 66, along with the wrapping film roll 68 disposed thereon, remain at their lowermost positions and do not in fact initially ascend or rise. Therefore, while the operator is moving or pushing the cart 12 around the palletized load located at the wrapping station, the operator will squeeze the first control lever 132 so as to in turn actuate the first control cable 114 and thereby cause, in effect, the clutched disengagement of the lift cable drum clutch pins 90 from the lift sprocket clutch holes 92, against the biasing force of clutch spring 106, through means of the clutch subassembly comprising the drum puller bar 102, bolt members 104, drum control ring 98, and lift cable drum flanged portion 94. Subsequently, when it is desired to in effect terminate the concentric or reinforcing wrapping of the lower end portion of the palletized load and to commence the spiral wrapping of the palletized load, the operator releases the first control lever 132 whereby the clutch spring 106 will bias the clutch subassembly in the axial direction toward the lift sprocket 60. When the lift sprocket 60 has undergone a predetermined amount of angular rotation with respect to the lift cable drum 62 such that the clutch holes 92 of the lift sprocket 60 are angularly aligned with the clutch pins 90 of the lift cable drum 62, the clutch pins 90 will become engaged within the clutch holes 92 and rotation-al or angular movement of the lift sprocket 60 will now be transmitted to the lift cable drum 62 whereby the lift cable 64 will now be wound upon the lift cable drum hub 63 so as to cause the film roll carriage 66 and the wrapping film roll 68 to rise or ascend. It is noted that during the lift cable winding stage, the lift cable 64 is permitted to pass by or cross the pawl mechanism 138 because the pawl mechanism 138 will in effect be pivotally moved to a substantially released position with respect to the lift cable 64 being wound.

It is thus to be appreciated that whenever concentric or reinforcing wrapping of the palletized load is to be achieved, the first control lever 132 is squeezed or operated so as to in effect achieve declutching of the lift cable drum 62 from the rotary drive of the lift sprocket 60, whereas whenever spiral wrapping of the palletized load is to be achieved as a result of the constant rising or elevation of the film roll carriage 66 and the wrapping film roll 68 disposed thereon, the first control lever 132 is simply permitted to remain in its normal, non-squeezed state. It is further noted that in accordance with the unique system 10 of the present invention, a substantially precise spiral wrapping of the palletized load can in fact be achieved because the rate of rise of the film roll carriage 66, and the wrapping film roll 68, as determined along its track 72, is determined by means of the various diametrical dimensions of the drive wheel 26, the drive sprocket 36, the lift sprocket 60, and the lift cable drum hub 63. More particularly, the drive wheel 26 preferably has a diametrical extent of sixteen inches (16.0"), the diametrical extent of the drive sprocket 36 is preferably approximately one and six-tenths inches (1.6"), the diametrical extent of the lift sprocket 60 is six inches (6.0"), and the diametrical extent of the lift cable drum spool 63 is two inches (2.0"). With the aforenoted diametrical dimensions implemented with respect to the noted system components, it has been determined that the film roll carriage 66 and the wrapping film roll 68 mounted thereon will rise approximately nine inches (9.0") during each circuit of the cart 12 around the palletized load disposed at the wrapping station.

When a complete wrapping cycle or operation has been completed with respect to a particular palletized load, and it is desired to move the film roll carriage 66 and the wrapping film roll 68 back to their lowermost positions as illustrated in FIG. 1 in preparation for a new wrapping cycle or operation to be performed upon a new palletized load, the operator will stop moving or pushing the cart 12, and it will be noted at this time that the film roll carriage 66 and the wrapping film roll 68 mounted thereon will remain at their previously elevated positions due to several factors. Firstly, since the cart 12 is no longer being moved or pushed, the lift cable 64 is no longer being wound upon the lift cable drum hub 63. However, retrograde or unwinding movement of the lift cable 64 with respect to the lift cable drum 62 cannot occur because the pawl mechanism 138 is now spring-biased into engagement with the lift cable 64 thereby compressing or trapping the same between the pawl mechanism 138 and its operatively associated support surface 141. Secondly, the lift cable drum 62 remains engaged with the lift sprocket 60 whereby, in effect, the intended reverse drive of such components, corresponding to the unwinding of the lift cable 64, would be transmitted back to the drive wheel 26, however, since the drive wheel 26 is stationary, retrograde or unwinding movement of the lift cable 64 cannot occur. Accordingly, in order to permit the descent of the film roll carriage 66 and the wrapping film roll 68 mounted thereon, such aforenoted first and second factors or states must be addressed.

The first factor or state is simply addressed by means of the actuation of the second control lever 134 which in turn controls the actuation of the second control cable 136 so as to cause the pivotal movement of the pawl mechanism 138 away from the lift cable 64. Consequently, the lift cable 64 is now free to unwind from the lift cable drum 62, however, in order to in fact permit the lift cable drum 62 to undergo rotational movement in the aforenoted clockwise direction CW-LCD and thereby permit the lift cable 64 to in fact be unwound from the lift cable drum 62, the mechanical and inertial drive parameters characteristic of the drive system must in effect be overcome. In order to achieve this goal, the apparatus or system 10 is further provided with a jack lever 142 which is pivotally mounted as at 143 upon the rearward horizontal deck portion 20 of the cart chassis 14 by means of a pair of laterally spaced mounting brackets 144, only one of which is shown in FIG. 1.

The jack lever 142 has a substantially L-shaped configuration wherein a depression pedal portion 146 is integrally provided upon the distal end portion of the long leg member, while a floor-engaging roller 148 is rotatably mounted upon the distal end portion of the short leg member. The jack lever 142 is normally spring-biased to the position shown in FIG. 1, however, when the jack lever pedal portion 146 is depressed downwardly in accordance with the arrow JLD, the jack lever 142 is rotated in the clockwise direction until the roller member 148 engages the floor 34. Continued downward depression of the jack lever pedal portion 146 causes the roller member 148 to in effect achieve an over-center position, that is, to be disposed at a position which is on the other side of a vertical plane 150 which passes through the drive wheel axle 32. In this manner, the spring-biasing effect of the jack lever 142 is overcome, the roller member 148 will remain in such overcenter position, and as a result of such disposition of the roller member 148, the pair of large wheels, and in particular, drive wheel 26, are now elevated above, and disengaged from, the floor 34. Accordingly, no further impediment to the unwinding of the lift cable 64 with respect to the lift cable drum 62 is present, and the lift cable 64 can in fact unwind from the lift cable drum 62 so as to permit descent of the film roll carriage 66 and the wrapping film roll 68 mounted thereon.

It is to be particularly noted that, as a result of the provision of the unique drive structure operatively associated with the lift cable drum 62, the descent of the film roll carriage 66 and the wrapping film roll 68 mounted thereon is accomplished in a substantially controlled manner whereby the film roll carriage 66 and the wrapping film roll 68 mounted thereon do not simply free-fall which would otherwise impact the central horizontal deck portion 18 of the chassis 14 with substantial force which would of course generate substantial noise and eventually cause damage to the chassis 14. More particularly, this controlled descent of the film roll carriage 66 and the wrapping film roll 68 mounted thereon is achieved as a result of the clutch-engaged state of the lift cable drum 62 with respect to the lift sprocket 60, and the provision of the lift sprocket 60 as a relatively large sprocket member having, for example, forty (40) sprocket teeth provided thereon, as well as the provision of the drive sprocket 36 as a relatively small sprocket member having, for example, ten (10) sprocket teeth provided thereon. Accordingly, a drive ratio of 4:1 is incorporated within the drive system as transmitted from the lift cable drum 62 to the drive sprocket 36. In addition, as a result of the provision of the one-way roller clutch 38 defined between the drive sprocket 36 and the axle 32-drive wheel 26 subassembly, the rotational inertia of the drive wheel 26 is accounted for and taken into consideration so as to play an integral part of the controlled descent movement of the film roll carriage 66 and the wrapping film roll 68 mounted thereon. In view of the fact that it is necessary to have the lift cable drum 62 remain in its clutch-engaged state with respect to the lift sprocket 60 during the unwinding of the lift cable 64 from the lift cable drum 62 so as to play an integral part in the controlled descent of the film roll carriage 66 and the wrapping film roll 68 mounted thereon, it is necessary, from a safety point of view, to prevent the simultaneous actuation of both of the first and second control cables 114,136 by means of the control levers 132 and 134. Accordingly, a cable tie member 152 is integrally connected to the control cables 114,136 such that only one control cable 114,136 can be actuated at any one time, or in other words, simultaneous actuation of the control cables 114,136 is effectively prevented. It is lastly noted in conjunction with the descent of the film roll carriage 66 and the unwinding of the lift cable 64 with respect to the lift cable drum 62, that the ball detents 100 provided upon the drum control ring 98 also serve to provide a predetermined amount of frictional drag upon the lift cable drum 62 during such unwinding of the lift cable 64 therefrom such that an excessive amount of lift cable 64 is not unwound from the lift cable drum 62, as a result of the rotational inertia of the lift cable drum 62, once the film roll carriage 66 has been lowered to its lowermost position.

Once the film wrapping cycle or operation has been completed, and the film roll carriage 66 has been lowered to its lowermost position as illustrated in FIG. 1, the portable apparatus or system 10 can of course be readily moved or transported to various locations, or simply moved to a storage location, by releasing the jack lever 142. This is accomplished by simply moving the cart 12 in the FORWARD direction upon the front wheels 22 whereby the roller 148 will be moved backwardly and the spring-biasing force of the jack lever mounting system will cause the jack lever to return to its position as illustrated in FIG. 1. If the apparatus or system 10 is moved in the rearward or backward direction as noted by the arrow BACKWARD in FIG. 1, as a result of, for example, the operator personnel actually pulling on the push bar handle structure, not shown, of the apparatus or system 10, the one-way roller clutch 38 will permit such movement without regard to, or causing, any winding of the lift cable 64 upon the lift cable drum 62. On the other hand, if the apparatus or system 10 is to be moved along the floor 34 in the forward direction, the first control lever 132 must be squeezed or operated so as to release the clutched engagement of the lift cable drum 62 with respect to the lift sprocket 60 such that the lift cable 64 is not in fact wound upon the lift cable drum 62. Otherwise, the lift cable 64 would be continuously wound upon the lift cable drum 62 whereby the film roll carriage would be moved to an uppermost position along its track 72 of the upstanding mast member 74 such that the system would ultimately in effect become jammed with no further movement possible.

Figure 7:
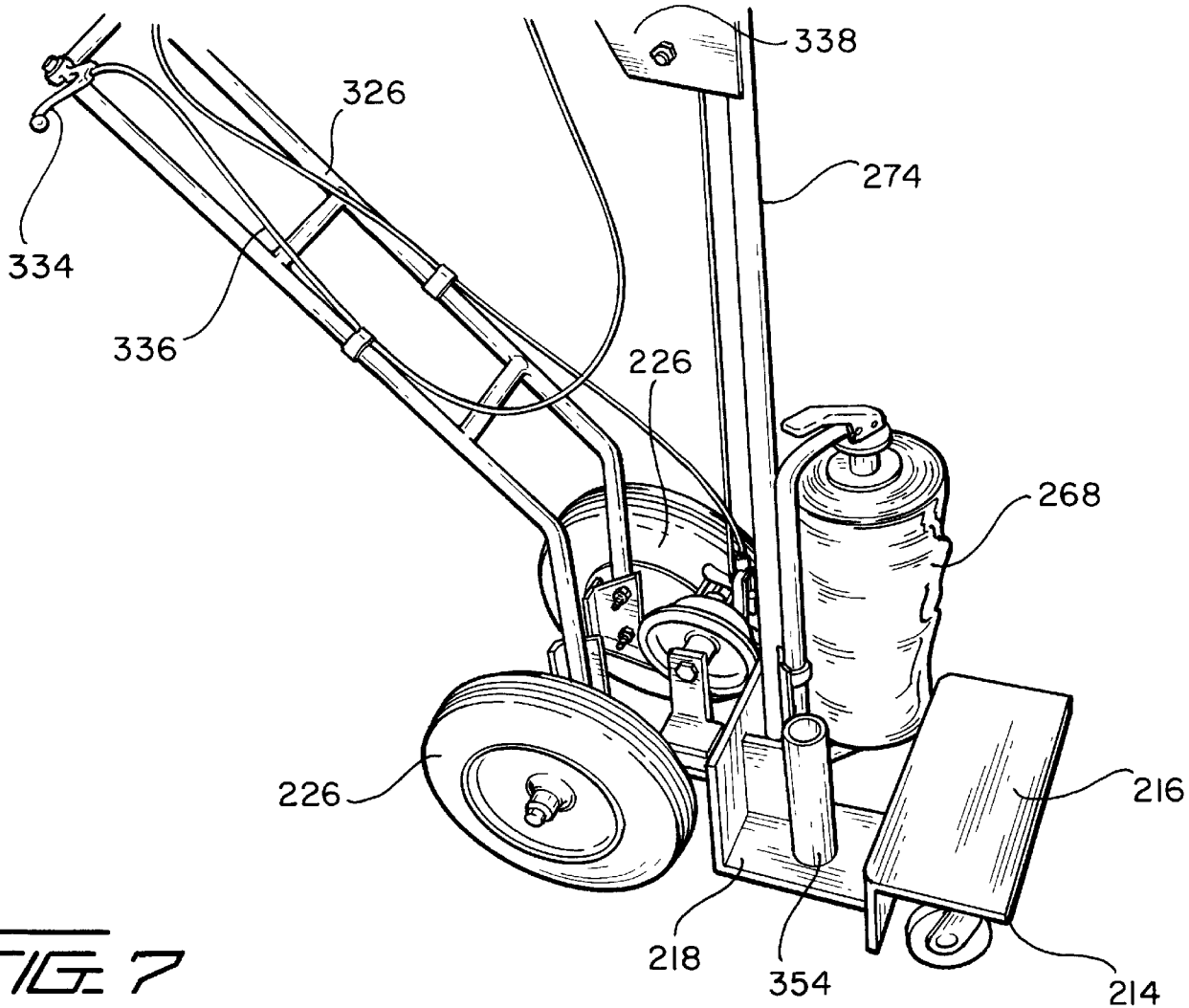
FIG. 7 is a right side perspective view of a second embodiment of the new and improved portable film wrapping apparatus or system which is essentially identical, but slightly modified with respect, to the first embodiment of the new and improved portable film wrapping apparatus as disclosed within FIG. 1, and which has therefore likewise been constructed in accordance with the teachings and principles of the present invention and which discloses the cooperative parts thereof.

With reference lastly being made to FIG. 7, a second embodiment of the new and improved portable film wrapping apparatus or system constructed in accordance with the principles and teachings of the present invention is disclosed and is generally designated by the reference character 210 as has been briefly noted hereinbefore. The apparatus or system 210 is substantially identical to the apparatus or system 10 disclosed within FIGS. 1–6, except as will be briefly described shortly, and consequently, a detailed discussion of the apparatus or system 210 will be omitted for brevity purposes. Major components of the apparatus or system 210 which are similar to or correspond with those components of the apparatus or system 10 have, however, been designated by similar reference characters except that the reference characters of the system or apparatus 210 are noted as being in the 200 and 300 series. More particularly, the only significant difference between the embodiment systems 10 and 210 of FIGS. 1 and 7 resides in the placement or location of a spare wrapping film roll mount. As seen in FIG. 1, for example, the forward horizontal deck section 16 of the chassis 14 is fixedly provided with an upstanding rod or pole 154 upon which a spare wrapping film roll 68 can be mounted, however, in accordance with the embodiment of the system 210 as disclosed within FIG. 7, the central horizontal deck portion 218 of the chassis 214 is provided with an upstanding wrapping film roll mounting pole or rod 354. The different locations of the wrapping film roll mounting poles or rods are employed depending upon the size of the wrapping film rolls. The location upon the central horizontal deck portion 218 of the chassis 214 is, for example, more confining or restrictive whereby only a relatively small-sized wrapping film roll would be able to be accommodated, whereas larger wrapping film rolls 68 can easily be accommodated upon the forward deck portion 16 of the chassis 14.

Thus, it may be seen that in accordance with the principles and teachings of the present invention, there has been provided a truly portable and transportable film wrapping apparatus or system which is readily controllable and steerable by means of a film wrapping operator. Controlled ascent and descent of the film wrapping carriage, and the wrapping film roll mounted thereon, is achieved, and in addition, both concentric or reinforcing and spiral wrapping modes are able to be readily and simply achieved under the control of the film wrapping operator.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. Portable apparatus adapted to be moved along a circular locus around an article disposed at a wrapping station so as to be capable of wrapping the article in wrapping film, comprising:

a manually movable portable push-cart;

a drive wheel mounted upon said portable push-cart and engageable with a horizontal surface for rotatable movement along the horizontal surface as said portable push-cart is moved relative to the horizontal surface;

a vertical mast member mounted upon said portable push-cart;

a carriage vertically movable upon said vertical mast member;

a roll of wrapping film mounted upon said carriage; and drive means interconnecting said drive wheel to said carriage for vertically moving said carriage, along with said roll of wrapping film mounted thereon, along said vertical mast member in response to rotational movement of said drive wheel such that as said drive wheel of said portable push-cart is rotatably moved along the horizontal surface, said carriage, along with said roll of wrapping film mounted thereon, will undergo vertical movement along said vertical mast member so as to enable the article to be wrapped within said wrapping film as said push-cart is moved along the circular locus around the article disposed at the wrapping station.

2. The apparatus as set forth in claim 1, wherein said drive system comprises:

a lift cable drum rotationally connected to said drive wheel such that when said drive wheel is rotatably moved along the horizontal surface, said lift cable drum is rotated; and a lift cable having a first end connected to said lift cable drum and a second end connected to said carriage such that when said lift cable drum is rotated in response to rotation of said drive wheel, said lift cable is wound upon said lift cable drum so as to cause vertical movement of said carriage, and said roll of wrapping film mounted thereon, along said vertical mast member.

3. The apparatus as set forth in claim 2, further comprising:

a clutch mechanism for moving said lift cable drum between a first position at which said lift cable drum is rotationally connected to said drive wheel such that said lift cable is wound upon said lift cable drum so as to cause vertical movement of said carriage, and said roll of wrapping film mounted thereon, along said vertical mast member whereby spiral wrapping of the article can be achieved as said portable push-cart is moved around the article, and a second position at which said lift cable drum is rotationally disconnected from said drive wheel such that said lift cable is no longer wound upon said lift cable drum whereby said carriage remains at a particular elevational level upon said vertical mast member such that concentric wrapping of the article can be achieved as said portable push-cart is moved around the article.

4. The apparatus as set forth in claim 3, further comprising:

a pawl mechanism operatively associated with said lift cable for permitting said lift cable to be wound upon said lift cable drum as said lift cable drum is rotated in a first direction as a result of being rotationally connected to said drive wheel whereby said film roll carriage is able to be moved upwardly along said vertical mast member, and for preventing said lift cable from being unwound from said lift cable drum when said lift cable drum is not rotated as a result of being rotationally disconnected from said drive wheel whereby said film roll carriage is maintained at a particular elevational level upon said vertical mast member.

5. The apparatus as set forth in claim 4, further comprising:

a second control cable operatively connected to said pawl mechanism for moving said pawl mechanism away from said lift cable when said lift cable drum is not rotated as a result of being rotationally disconnected from said drive wheel so as to permit said lift cable to be unwound from said lift cable drum whereby said film roll carriage can descend downwardly along said vertical mast member.

6. The apparatus as set forth in claim 2, wherein said drive system further comprises:

a drive wheel axle upon which said drive wheel is fixedly mounted;

a drive sprocket mounted upon said drive wheel axle;

a lift sprocket operatively connected to said lift cable drum; and a drive chain interconnecting said drive sprocket and said lift sprocket such that rotatable drive is able to be serially transmitted from said drive wheel to said drive wheel axle, to said drive sprocket, to said drive chain, to said lift sprocket, and to said lift cable drum.

7. The apparatus as set forth in claim 6, wherein:

said drive sprocket includes a one-way clutch mechanism such that when said drive wheel is rotated in a first rotational direction, rotary drive is transmitted from said drive wheel axle to said drive sprocket, whereas when said drive wheel is rotated in a second opposite direction, rotary drive is not transmitted from said drive wheel axle to said drive sprocket.

8. The apparatus as set forth in claim 6, further comprising:

a clutch mechanism for moving said lift cable drum between a first position at which said lift cable drum is rotationally connected to said lift sprocket such that said lift cable is wound upon said lift cable drum so as to cause vertical movement of said carriage, and said roll of wrapping film mounted thereon, along said vertical mast member whereby spiral wrapping of the article can be achieved as said portable push-cart is moved around the article, and a second position at which said lift cable drum is rotationally disconnected from said lift sprocket such that said lift cable is no longer wound upon said lift cable drum and said carriage remains at a particular elevational level upon said vertical mast member whereby concentric wrapping of the article can be achieved as said portable push-cart is moved around the article.

9. The apparatus as set forth in claim 8, wherein said clutch mechanism comprises:

a plurality of clutch holes defined within said lift sprocket; and a plurality of clutch pins mounted upon said lift cable drum.

10. The apparatus as set forth in claim 9, further comprising:

a clutch shaft upon which said lift sprocket and said lift cable drum are rotatably mounted;

a coil spring mounted upon said clutch shaft for biasing said lift cable drum toward said lift sprocket, whereupon alignment of said clutch pins of said lift cable drum with said clutch holes defined within said lift sprocket, said lift cable drum will be rotationally engaged with said lift sprocket; and a first control cable operatively connected to said lift cable drum for moving said lift cable drum away from said lift sprocket against the biasing force of said coil spring so as to operatively disengage said clutch pins of said lift cable drum from said clutch holes defined within said lift sprocket such that said lift cable drum is rotationally disengaged from said lift sprocket.

11. The apparatus as set forth in claim 10, further comprising:

a pawl mechanism operatively associated with said lift cable for permitting said lift cable to be wound upon said lift cable drum as said lift cable drum is rotated in a first direction as a result of being rotationally connected to said drive wheel whereby said film roll carriage is able to be moved upwardly along said vertical mast member, and for preventing said lift cable from being unwound from said lift cable drum when said lift cable drum is not rotated as a result of being rotationally disconnected from said drive wheel whereby said film roll carriage is maintained at a particular elevational level upon said vertical mast member.

12. The apparatus as set forth in claim 11, further comprising:

a second control cable operatively connected to said pawl mechanism for moving said pawl mechanism away from said lift cable when said lift cable drum is not rotated as a result of being rotationally disconnected from said drive wheel so as to permit said lift cable to be unwound from said lift cable drum whereby said film roll carriage can descend downwardly along said vertical mast member.

13. The apparatus as set forth in claim 12, further comprising:

a tie member interconnecting said first and second control cables such that only one of said first and second control cables can be actuated at any one time.

14. The apparatus as set forth in claim 8, further comprising:

a pawl mechanism operatively associated with said lift cable for permitting said lift cable to be wound upon said lift cable drum as said lift cable drum is rotated in a first direction as a result of being rotationally connected to said drive wheel whereby said film roll carriage is able to be moved upwardly along said vertical mast member, and for preventing said lift cable from being unwound from said lift cable drum when said lift cable drum is not rotated as a result of being rotationally disconnected from said drive wheel whereby said film roll carriage is maintained at a particular elevational level upon said vertical mast member.

15. The apparatus as set forth in claim 14, further comprising:

a second control cable operatively connected to said pawl mechanism for moving said pawl mechanism away from said lift cable when said lift cable drum is not rotated as a result of being rotationally disconnected from said drive wheel so as to permit said lift cable to be unwound from said lift cable drum whereby said film roll carriage can descend downwardly along said vertical mast member.

16. The apparatus as set forth in claim 15, wherein:

said lift sprocket is provided with forty (40) sprocket teeth; and said drive sprocket is provided with ten (10) sprocket teeth, whereby a rotary drive having a ratio of 4:1 is defined within said drive system so as provide a controlled descent of said film roll carriage when said lift cable is unwound from said lift cable drum.

17. The apparatus as set forth in claim 16, further comprising:

a jack lever mounted upon said push-cart for movement between a first position at which said drive wheel is permitted to be disposed in contact with the horizontal surface, and a second position at which said drive wheel is elevated with respect to the horizontal surface so as to permit said rotary drive to be transmitted to said elevated drive wheel in order to permit said controlled descent of said film roll carriage.

18. Portable apparatus adapted to be moved along a circular locus around an article disposed at a wrapping station so as to be capable of wrapping the article in wrapping film, comprising:

a manually movable portable push-cart;

a drive wheel mounted upon said portable push-cart and engageable with a horizontal surface for rotatable movement along the horizontal surface as said portable push-cart is moved relative to the horizontal surface;

a vertical mast member mounted upon said portable push-cart;

a carriage vertically movable upon said vertical mast member;

a roll of wrapping film mounted upon said carriage;

a lift sprocket operatively connected to said drive wheel so as to be drivingly rotated in response to said rotatable movement of said drive wheel;

a lift cable drum;

a lift cable having a first end connected to said lift cable drum and a second end connected to said carriage; and a clutch mechanism for moving said lift cable drum between a first position at which said lift cable drum is rotationally connected to said lift sprocket so as to be rotated by said lift sprocket in response to said rotatable movement of said drive wheel whereby said lift cable is wound upon said lift cable drum so as to cause vertical movement of said carriage, and said roll of wrapping film mounted thereon, along said vertical mast member such that spiral wrapping of the article within said wrapping film can be achieved as said portable push-cart is moved around the article disposed at the wrapping station, and a second position at which said lift cable drum is rotationally disconnected from said lift sprocket whereby said lift cable is no longer wound upon said lift cable drum such that said carriage remains at a particular elevational level upon said vertical mast member whereby concentric wrapping of the article within said wrapping film can be achieved as said portable push-cart is moved around the article disposed at the wrapping station.

19. The apparatus as set forth in claim 18, wherein said clutch mechanism comprises:

a plurality of clutch holes defined within said lift sprocket; and a plurality of clutch pins mounted upon said lift cable drum.

20. The apparatus as set forth in claim 19, further comprising:

a clutch shaft upon which said lift sprocket and said lift cable drum are rotatably mounted;

a coil spring mounted upon said clutch shaft for biasing said lift cable drum toward said lift sprocket, whereupon alignment of said clutch pins of said lift cable drum with said clutch holes defined within said lift sprocket, said lift cable drum will be rotationally engaged with said lift sprocket; and a first control cable operatively connected to said lift cable drum for moving said lift cable drum away from said lift sprocket against the biasing force of said coil spring so as to operatively disengage said clutch pins of said lift cable drum from said clutch holes defined within said lift sprocket such that said lift cable drum is rotationally disengaged from said lift sprocket.

21. The apparatus as set forth in claim 20, further comprising:

a pawl mechanism operatively associated with said lift cable for permitting said lift cable to be wound upon said lift cable drum as said lift cable drum is rotated in a first direction as a result of being rotationally connected to said lift sprocket whereby said film roll carriage is able to be moved upwardly along said vertical mast member, and for preventing said lift cable from being unwound from said lift cable drum when said lift cable drum is not rotated as a result of being rotationally disconnected from said lift sprocket whereby said film roll carriage is maintained at a particular elevational level upon said vertical mast member.

22. The apparatus as set forth in claim 21, further comprising:

a second control cable operatively connected to said pawl mechanism for moving said pawl mechanism away from said lift cable when said lift cable drum is not rotated as a result of being rotationally disconnected from said lift sprocket so as to permit said lift cable to be unwound from said lift cable drum whereby said film roll carriage can descend downwardly along said vertical mast member.

23. The apparatus as set forth in claim 22, further comprising:

a tie member interconnecting said first and second control cables such that only one of said first and second control cables can be actuated at any one time.

24. The apparatus as set forth in claim 22, wherein:

said lift sprocket is provided with forty (40) sprocket teeth; and said drive sprocket is provided with ten (10) sprocket teeth, whereby a rotary drive having a ratio of 4:1 is defined within said drive system so as provide a controlled descent of said film roll carriage when said lift cable is unwound from said lift cable drum.

25. The apparatus as set forth in claim 24, further comprising:

a jack lever mounted upon said push-cart for movement between a first position at which said drive wheel is permitted to be disposed in contact with the horizontal surface, and a second position at which said drive wheel is elevated with respect to the horizontal surface so as to permit said rotary drive to be transmitted to said elevated drive wheel in order to permit said controlled descent of said film roll carriage.

* * * * *